US005240455A

United States Patent [19]

Sharp

[11] Patent Number: 5,240,455

[45] Date of Patent: Aug. 31, 1993

[54] METHOD AND APPARATUS FOR CONTROLLING A FUME HOOD

[75] Inventor: Gordon P. Sharp, Newton, Mass.

[73] Assignee: Phoenix Controls Corporation, Newton, Mass.

[21] Appl. No.: 749,279

[22] Filed: Aug. 23, 1991

[51] Int. Cl.[5] ..... B08B 15/02

[52] U.S. Cl. ..... 454/61; 454/343

[58] Field of Search ..... 454/56, 61, 62, 343

[56] References Cited

U.S. PATENT DOCUMENTS

| | | | |
|---|---|---|---|
| 4,105,015 | 8/1978 | Isom | 454/343 X |
| 4,528,898 | 7/1985 | Sharp et al. | 454/61 |
| 4,706,553 | 11/1987 | Sharp et al. | 454/61 |
| 4,741,257 | 5/1988 | Wiggin et al. | 454/56 |
| 4,773,311 | 9/1988 | Sharp | 454/56 |

*Primary Examiner*—William E. Tapolcai

*Attorney, Agent, or Firm*—Wolf, Greenfield & Sacks

[57] ABSTRACT

This invention relates to a fume hood controlling method and apparatus which reduces the amount of replacement air required to operate a fume hood by permitting the fume hood to operate at a relatively low face velocity in the absence of a containment affecting condition, but which is capable of detecting the occurrence of a containment affecting condition, such as the presence or movement of a user within a selected area of the face of the fume hood, and of increasing face velocity to a selected level in response to such detection. When the detected condition no longer exists, the control automatically returns the fume hood to the lower face velocity, preferably with a time delay. Maximum replacement air volume and minimum replacement air volume may also be controlled in response to such detection.

30 Claims, 7 Drawing Sheets

METHOD AND APPARATUS FOR CONTROLLING A FUME HOOD

FIELD OF THE INVENTION

This invention relates to laboratory fume hood controllers and more specifically to methods and apparatus for varying a fume hood's face velocity in response to variations in one or more hood containment affecting conditions.

BACKGROUND OF THE INVENTION

A laboratory fume hood is a ventilated enclosure where harmful materials can be handled safely. The hood captures contaminants and prevents them from escaping into the laboratory by using an exhaust blower to draw air and contaminants in and around the hood's work area away from the operator so that inhalation of and contact with the contaminants are minimized. Access to the interior of the hood is through an opening which is closed with a sash which typically slides up and down to vary the opening into the hood.

The velocity of the air flow through the hood opening is called the face velocity. The more hazardous the material being handled, the higher the recommended face velocity, and guidelines have been established relating face velocity to toxicity. Typical face velocities for laboratory fume hoods are 60 to 150 feet per minute (fpm), depending upon the application.

When an operator is working in the hood, the sash is opened to allow free access to the materials inside. The sash may be opened partially or fully, depending on the operations to be performed in the hood. While fume hood and sash sizes vary, the opening provided by a fully opened sash is on the order of ten square feet. Thus the maximum air flow which the blower must provide is typically on the order of 600 to 1500 cubic feet per minute (cfm).

The sash is closed when the hood is not being used by an operator. It is common to store hazardous materials inside the hood when the hood is not in use, and a positive airflow must therefore be maintained to exhaust contaminants from such materials even when the hood is not in use and the sash is closed. As the hazard level of the materials being handled and the resulting minimum face velocity increases, maintaining a safe face velocity becomes more difficult.

An important consideration in the design of a fume hood system is the cost of running the system. There are three major areas of costs: the capital expenditure of installing the hood, the cost of power to operate the hood exhaust blower, and the cost of heating, cooling, and delivering the "make-up air," which replaces the air exhausted from the room by the fume hood. For a hood operating continuously with an opening of 10 square feet and a face velocity of 100 fpm, the cost of heating and cooling the make up air could, for example, run as high as fifteen hundred dollars per year in the northeastern U.S. Where chemical work is done, large numbers of fume hoods may be required. For example, the Massachusetts Institute of Technology has approximately 650 fume hoods, most of which are in operation 24 hours a day.

Capital or investment costs is an important factor in the design of fume hood systems. This relates to the capital cost of the supply and exhaust fans, duct work, boiler and chillers, and other equipment related to the movement and conditioning of the outside air brought into and exhausted from the building through the fume hoods. The size, capacity and cost of this equipment is integrally related to the peak capacity of air volume to be exhausted from the hoods. This total volume is in turn directly related to the face velocities of those hoods. For example, a 20% reduction in the face velocity for which the building hoods are designed, from 100 FPM to 80 FPM allows for a 20% reduction in the required capacity of the system air handling equipment.

Consequently, there are strong economic reasons for using the lowest face velocity which still produces acceptable fume hood capture and containment. Much research has been performed recently on the factors affecting this minimum acceptable face velocity. For example, with a fume hood having no equipment in the first 6" back from the sash, uniform face velocity distribution across the face of the hood, and no high cross drafts, the face velocity can be set to 60 FPM and excellent containment will occur. However, spillage will occur at 60 FPM if people walk past the hood, someone waves their arms near the opening or supply air diffusers blow air past the corners in front of the hood. All these disturbances create cross drafts and challenges to the fume hood containment which can pull fumes out of the hood. Increasing the face velocity to 100 or 125 FPM significantly reduces the spillage caused by these factors. Above 150 FPM, the air flow into the hood can become turbulent creating eddy currents and local low pressure areas which can also create spillage.

Because of the above factors, many laboratories operate their hoods at 100 to 125 FPM. Others allow the face velocities to drop to 70 to 80 FPM when the laboratories are unoccupied and operators are not near the hood where they might create crossdrafts from their motions. A very few companies operate their hoods at 60 FPM, but only with strict operating guidelines in order to prevent disturbance of the fume hood's containment.

In order to save energy and reduce the peak air capacity in laboratories, fume hood control systems are presently used that maintain a constant face velocity independent of the sash opening. Early versions of these systems operated by changing volume in a two or three step operation based on the sash height or the amount of sash opening. Much better and more recent systems provide continuous control of the air volume based on sash position and are referred to as variable air volume systems. An example of one of these systems is described in U.S. Pat. Nos. 4,528,898 and 4,706,553. These systems work well, but are dependent on the operator lowering the sash. When the operator does lower the sash, the exhaust, and typically also the room supply air volume, are reduced proportionately which generates the energy savings. If many hoods are used in a building with these controls, both the average and typical peak total air volumes will be reduced due to the diversity in the hood's operation. In other words, it is unlikely that all the hoods will be fully open at any one time. A problem for the building designer, however, is in estimating how much diversity will actually occur in the building. Consequently, many designers take a worst case view and don't size the buildings capacity below or much below the 100% capacity assumption of all the hoods full open at the same time. This is done because the designer is concerned that the users will not lower the sash when leaving the hood area. This is unfortunate because studies have shown that operators spend only a small fraction of their time in front of the hood.

In an attempt to bypass the operator problem of not closing sashes some fume hood manufacturers have introduced devices such as shown in U.S. Pat. No. 4,774,878 that detect the presence of the operator in front of the hood and raise the sash to some preset position. When the operator moves away from the hood, the sash is automatically closed. Typically, a two state or variable air volume control system is also used to vary the air volumes to maintain a constant face velocity at the two different sash positions.

These sash operator systems have not as of yet received widespread acceptance among researchers for several reasons. Firstly, the rapid movement of the sash up and down can occur even when a person just walks past the hood, producing a disturbing false reaction of the hood. Also, many researchers like to operate the sash at various heights, and this is made more difficult by the two position operators. Further, many hoods have wires, tubes and small hoses going into the hood near the bottom of the sash opening. Uncontrolled movement of the sash might hit these wires and hoses and potentially tip over delicate glassware to which the tubes and hoses are connected. This in turn could create a serious and potentially dangerous accident. Lastly, many hoods have horizontally moving sashes which make it difficult to implement a system to move the sashes in order to increase or decrease the amount of hood opening.

For all of the above reasons, a better approach is needed for reducing both energy usage and peak estimated replacement volume while not creating a potential hazard and not adversely affecting the researcher's work.

SUMMARY OF THE INVENTION

An object of this invention is to provide an improved method and apparatus for controlling a fume hood, which controller (a) substantially reduces the replacement air utilized by the system, regardless of sash position, (b) permits fume hood systems to be designed for lower peak volume flow without permitting or creating any danger of a breakdown in toxic fume containment or any danger of damage to ongoing experiments or equipment, and (c) permits researchers complete flexibility in selecting sash positions.

In accordance with the above, this invention provides a controller for use with a fume hood having a face velocity control. The face velocity control may control face velocity directly or may control it indirectly by controlling flow volume or some other conditions affecting face velocity. The controller has a detector for detecting at least one containment affecting condition, which condition may be (a) the presence or proximity of a person within a predetermined area of the fume hood, (b) movement within a predetermined area of the fume hood, either by a person or as a result of air drafts or other conditions, and/or (c) the presence of equipment or material within a predetermined distance from the front of the hood. Appropriate detectors are provided for each condition to be detected. In response to the detector detecting a selected change in containment affecting conditions, the face velocity control makes a corresponding change in the face velocity of the fume hood to a preselected velocity which is appropriate for the changed containment condition. The change may be an increase in the face velocity of the fume hood to a level sufficient to assure containment of fumes in the hood with the containment affecting condition present, or the change may be a reduction in the face velocity of the fume hood to a selected decreased level in response to the detection of a selected reduction in containment affecting condition. The incrementing preferably occurs substantially instantaneously on the detection of a containment affecting condition, while a reduction in face velocity is delayed for a selected time period when a selected reduction in containment affecting condition is detected. Containment affecting conditions may include a person being within a selected area of the face of the hood, the detection of movement within a selected area of the face of the hood, which movement may be of a person or may be air motion or turbulance either inside or outside the hood, may be a tracer fluid ejected in the hood, with the escape of such tracer fluid being measured, or may be the detection of apparatus within a predetermined distance from the front of the hood.

The face velocity control may control volume through the fume hood with a change being a change in flow volume. The system may include a means for establishing a maximum flow volume and/or a means for establishing a minimum flow volume with the maximum flow volume and/or the minimum flow volume being changed in response to a change in containment affecting condition. An offset in the controlled flow volume may also be effected in response to a change in containment affecting condition. Where the fume hood has an opening which may be covered to varying extents by at least one moveable sash, a selected volume is normally maintained relative to the sash position. The selected volume maintained may be changed in response to the detection of a change in containment affecting condition. For some embodiments, the selected volume maintained is a constant volume regardless of sash position.

For some embodiments, a first face velocity is caused in response to a detection of a containment affecting condition, and a second lower face velocity is caused in response to the absence of a detection. Where there may be varying degrees of containment, and the detection detects the degree of containment affecting condition, the change in face velocity may be to a face velocity appropriate for the detected degree of containment affecting condition. The changes in face velocity may be discrete or may be substantially continuous based on the degree of detected containment affecting condition.

The face velocity control may include a speed control for a blower exhausting the fume hood, or may directly change the flow from the fume hood.

The foregoing other objects, features, and advantages of the invention will be apparent from the following more particular description of preferred embodiments of the invention as illustrated in the accompanying drawings.

IN THE DRAWINGS

DETAILED DESCRIPTION

Figure 1:
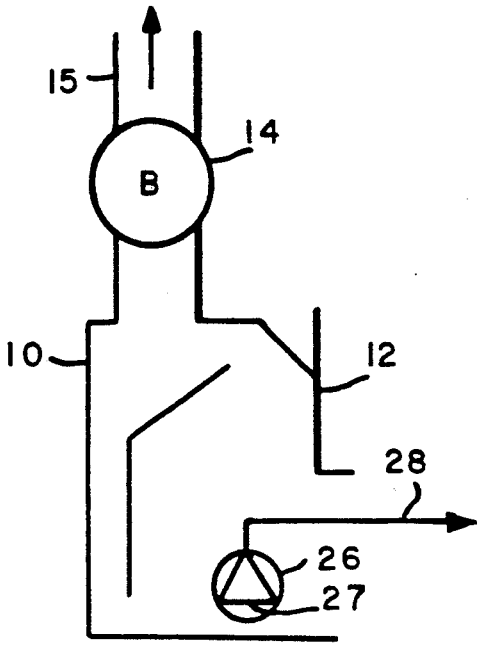
FIG. 1 PRIOR ART
FIG. 1 is a side-view representation of a prior art fume hood system.

FIG. 1 shows a prior art system used primarily to maintain a constant face velocity. Air flow sensor 27 is placed in an opening in the fume hood so that it can directly sense the velocity of air entering the hood. Sensor 27 could be placed in the sash opening or in a separate opening in the side of hood enclosure 10, as shown by opening 26 in FIG. 1. In this system, the sensor may be used to control either the speed of blower 14 or to control a damper in the exhaust ducting 15 to control the air flow. U.S. Pat. No. 4,741,257 describes a similar device that measures the pressure drop between the inside and outside of the hood as a method of sensing a quantity related in some way to face velocity.

Systems of the type shown in FIG. 1 have several problems relating to the maintenance of a constant face velocity such as speed of response, stability, susceptibility to contamination of the air flow sensor, etc. One potential problem which relates to the present invention is that the face velocity of a hood controlled by these devices is affected by the user standing close to the front of the hood. However, unlike the present invention, these systems reduce the face velocity when the user stands near the opening of the hood, which is directly opposite of the desired result. The present invention increases the average face velocity to generate better fume hood capture and containment.

Prior art devices also work slowly, so that even if they could produce the intended result, it would be too late to protect the user. Due both to the time delay and the wrong control action of these systems, the disturbance of a person walking past the hood could create a significantly worse reaction than a hood with no such control system. The present invention uses different sensing and control equipment to immediately detect the disturbance and respond rapidly in the correct manner to provide better fume hood operation.

The present invention also differs from prior art systems that detect the presence of a user and raise the sash while trying to maintain a constant face velocity for two different sash positions. The goal of such prior art systems is to maintain a constant face velocity, or if no volume controller is used, then the volume may actually be fixed. The present invention also tries to sense the user, but unlike the prior art, it changes face velocity to change the hood volume and save energy; it does not disturb or move the hood sash or sashes.

Consequently, the present invention is universally applicable to all hoods even those that do not have a movable sash or such hoods as canopy hoods. Also, this system, when used in combination with a constant face velocity control system such as that described in U.S. Pat. Nos. 4,528,898 and 4,706,553, can achieve greater energy savings then when such systems are used alone due to the decrease in average face velocity that the present invention achieves.

Figure 2:
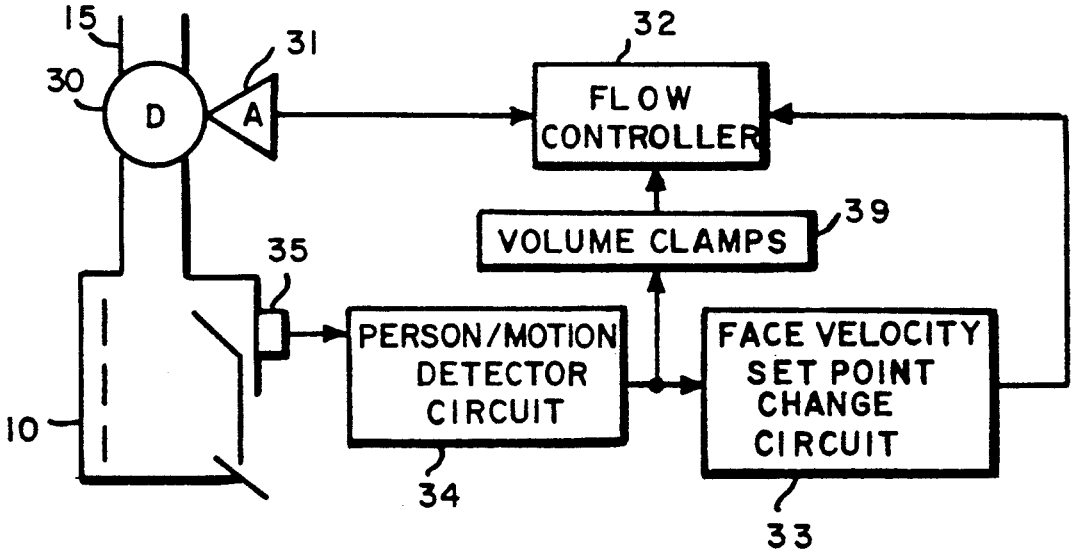
FIG. 2 is a semi block diagram of a fume hood system in accordance with a first embodiment of the invention.

Referring to FIG. 2, a first embodiment of the present invention is shown as it would be applied to a conventional fume hood with a damper 30 or similar air throttling or resistance type flow control element. This damper controls the flow out of fume hood 10 and is actuated by actuator 31. Flow controller 32 controls actuator 31 and may consist of a constant volume controller to maintain a given volume flow independent of sash position, a two state (or multi-state) volume controller that changes the volume of the hood based on the sash height or open area of the sash, or a variable volume control system which maintains a constant face velocity based on sash position. U.S. Pat. Nos. 4,741,257; 4,528,898; and 4,706,553 describe various types of variable volume control systems which could be used for flow controller block 32. All of these flow controllers work to maintain a given setpoint value of face velocity. In the constant volume systems, this can be interpreted directly as a setpoint of volume, whereas in the variable volume systems the fume hood volume will vary for a given face velocity setpoint. In many cases, with the variable volume systems, there will also be a minimum and maximum exhaust volume limit placed on the fume hood control.

Transducer 35 and person/motion detector circuit 34 work together to detect the presence and movement of the user/researcher in front of the hood. The transducer may also detect significant air motion or turbulence in front of or near the hood. When air motion or user proximity/movement is detected, it activates face velocity setpoint change circuit 33. This circuit acts on flow controller 32 in one of many possible ways, but generally acts to increase its face velocity and/or volume flow setpoint. Alternatively, it may act to modify the minimum and maximum exhaust volume limits of the flow controller through the volume clamps circuit 39.

Transducer 35 and detector circuit 34 may be implemented with a variety of technologies such as is used in security or intrusion alarm systems. For example, transducer 35 could be implemented by using a passive far-infrared (typically 8–14 um) motion sensor, an active ultrasonic motion sensor, an active microwave motion sensor, an active near infrared (typically 880–940 nm) or visible light proximity sensor, or a combination thereof. Based on the type of transducer used, a compatible detector circuit 34 would be employed.

Figure 3:
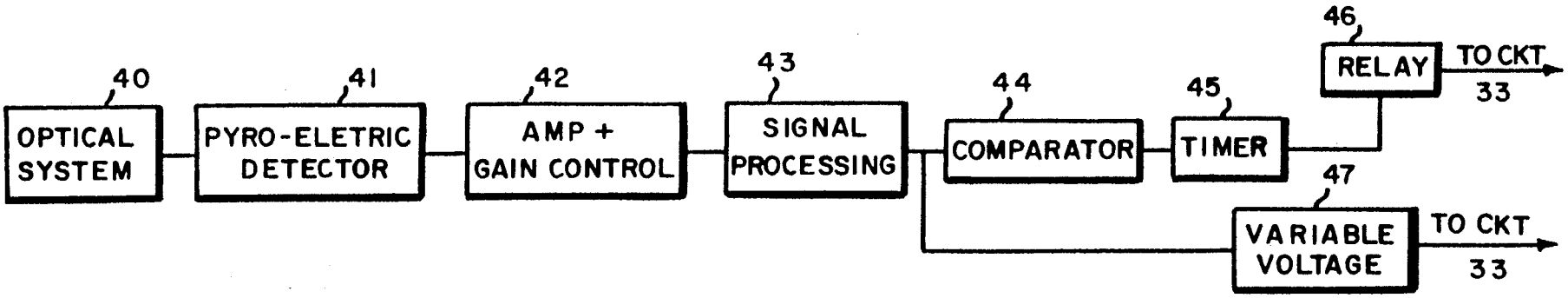
FIG. 3 and FIG. 4 are block diagrams of a passive and of an active motion detection system, respectively, which may be utilized in practicing the teachings of this invention.

FIG. 3 illustrates an implementation using a passive pyro-electric infrared motion sensor and detector circuit. The pyro electric detector 41 detects changes in heat patterns caused by the movement of a person relative to their background radiation, in a detection zone. The optical system 40, for example a mirror or fresnel lens, focuses the infrared energy, in for example the 8–14 um spectrum, onto the detector. After a variable gain stage 42 which controls the sensitivity of detection, the amplified signal is filtered in signal processing circuit 43 with a band pass filter which attenuates unwanted frequency of interest which is generally in the 0.3—3 Hz range. When the signal is of a desired amplitude, comparator 44 triggers a timer 45. The timer changes the state of relay (46), and thus of its output, for some preset time period. The output from relay 46 is applied to control change circuit 33 (FIG. 2).

The timer will restart its timing period if the comparator triggers a second time within the preset time period. This preset time period, or turn off delay time, is used to keep the detector on even if the researcher is still for a few minutes while he is working in front of the hood, and also to prevent the nuisance and potential danger of the system increasing and decreasing the face velocity based on how still the researcher is while the researcher is still in front of the hood. Alternatively, a smaller turn off delay could be used if the passive system were combined with some sort of active proximity or presence detector With the use of variable voltage control 47 the circuit could detect different zones. For example the variable voltage output would indicate the detection of the researcher in the lab relative to a detection zone in front of the fume hood. The variable voltage would tell the face velocity setpoint change block 33 of FIG. 2 to increase the face velocity a little when the researcher is present in the room and to increase the face velocity even more if the researcher is in front of the hood.

Figure 4:
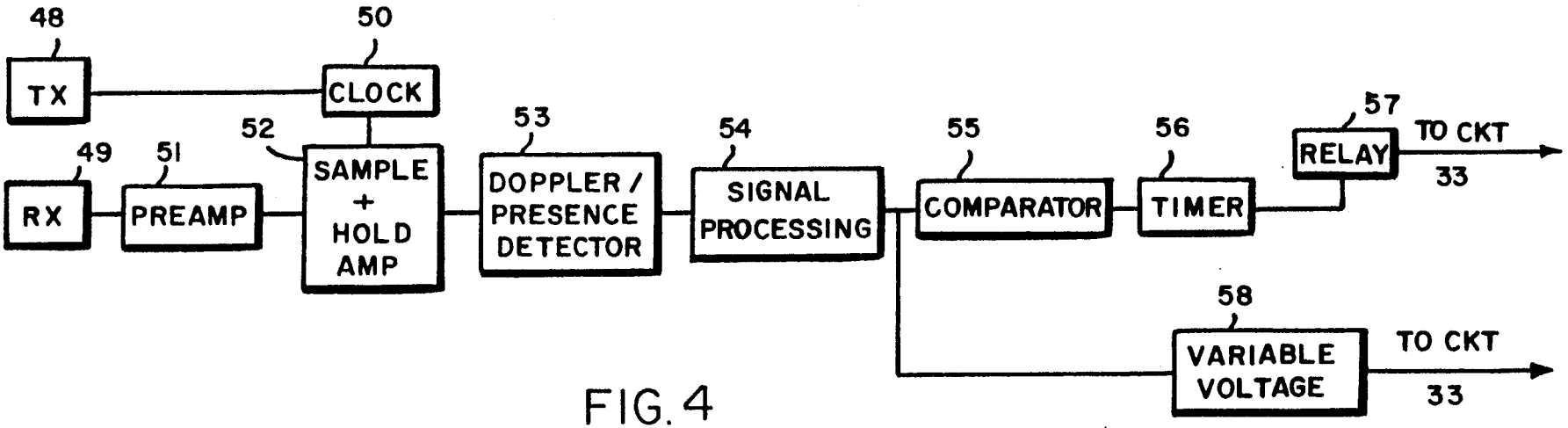

A complete active system that includes a Doppler motion detection is shown in FIG. 4. These systems can be combined with a passive detector and are typically based on one of three technologies: infrared 800–900 nm, microwaves or ultrasonics. The active system detects the presence and or movement of a person. Movement, which indicates where the researcher is and how fast he is moving, is detected by the Doppler effect for microwave and ultrasonics. Presence, which indicates if the researcher is present at a particular location, is detected by an infrared beam.

For the circuit of FIG. 4, transmitter 48 sends a pulse of appropriate frequency into the detection zone. Depending on the presence of personnel in the detection zone, the pulse is either returned to the receiver 49 within a selected clock interval or not. If the receiver receives the signal, preamplifier 51 boosts the signal so that, assuming the signal is received within the interval of clock 50, sample and hold amplifier 52 can sample the pulses, with the signals of interest on them. The pulses are sampled in sync with the transmitted pulses of clock 50. Doppler/presence detector 53 detects the motion or presence from the sampled signal, the presence detector detecting presence of a signal and the Doppler detector detecting frequency shift. The signal is filtered and processed in signal processing circuit 54 so that unwanted signals are attenuated, thus increasing the S/N ratio for the frequency of interest.

The block diagram of FIG. 4 illustrates two potential outputs, one indicating if the researcher is in the detection zone and the other detecting where in the zone the researcher is. In the first case, detecting if the researcher is in the detection zone, the output of relay 57 tells the face velocity setpoint change block 33 of FIG. 2 to increase the face velocity by a present amount. The later case would change the face velocity by a certain percent relative to the distance of the researcher from the hood.

The presence of the researcher in the detection zone is indicated by the signal amplitude out of block 54 increasing until it rises above the threshold of the comparator 55. The comparator starts a timer 56. The timer switches the state of the relay 57 for some preset time. As for the circuit of FIG. 3, the timer will reset back to zero if the comparator triggers a second time within the timer set period. The relay tells the face velocity setpoint change block 33 (FIG. 2) to change the face velocity.

To indicate the position of the researcher relative to the fume hood, the signal coming out of block 54 would be converted to a variable voltage by circuit 58, the voltage output telling the face velocity setpoint change block 33 (FIG. 2) the distance of the researcher from the fume hood. The face velocity may then be increased as the researcher moves closer to the fume hood and decreased as the researcher moves further from the fume hood.

The use of both a presence detector and a motion detector may prove useful to prevent the system from being adversely affected by people walking past the hood. If someone walks past the hood, the system must quickly activate the active mode. However, if the person does not stop in front of the hood, but continues walking, it would be wasteful to leave the hood in the active mode for more than perhaps 10 seconds. This prevents a person from walking around the room and activating all the hoods simultaneously. The presence detector is desirable for use in conjunction with the motion detector so that the active mode is only left on for greater than 10 seconds if a researcher remains standing in front of the hood.

Figure 5:
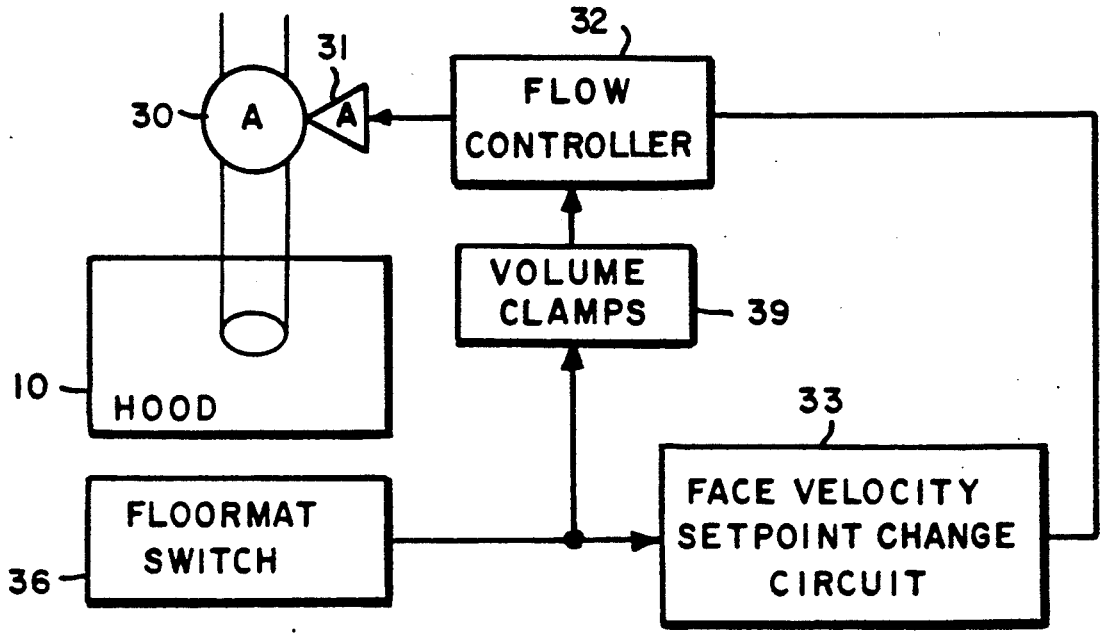
FIG. 5 is a block diagram of an alternative embodiment of the invention illustrating another sensing concept.

FIG. 5 illustrates another sensing concept to detect a person walking up to and standing in front of the hood. This involves a floor mat type switch 36 which is activated by standing on a special mat placed in front of the hood. These devices are of the general type used to open doors, although generally modified in appearance and construction to fit in better for a laboratory application. For example a capacitive plate sensor or inductive plate sensor which would operate by stepping on a sheet of metal either on top of or embedded into the floor would provide a neater installation for this application which would be less affected by spilled chemicals. There are also many similar sensors such as piezoelectric or FSR (Force Sensing Resistor) which are very flat and can for example be laminated into corrosion resistant plastic. Detectors of this type typically work on pressure or on the capacitive or conductive affects of the human body. Except for the change in detector, the system of FIG. 5 has the same components and operates in the same way as the system of FIG. 2.

Figure 6A:
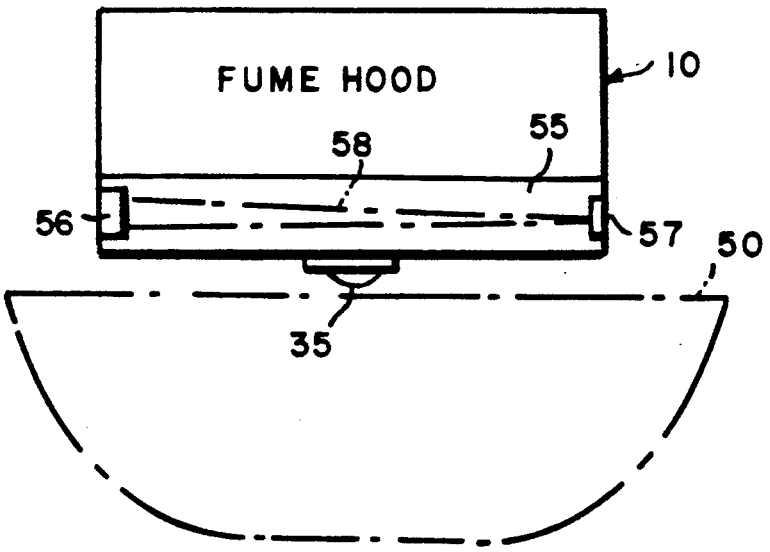
FIG. 6A illustrates a typical detection zone for a proximity or motion detector and also illustrates the detection of another detection containment condition.
Figure 6B:
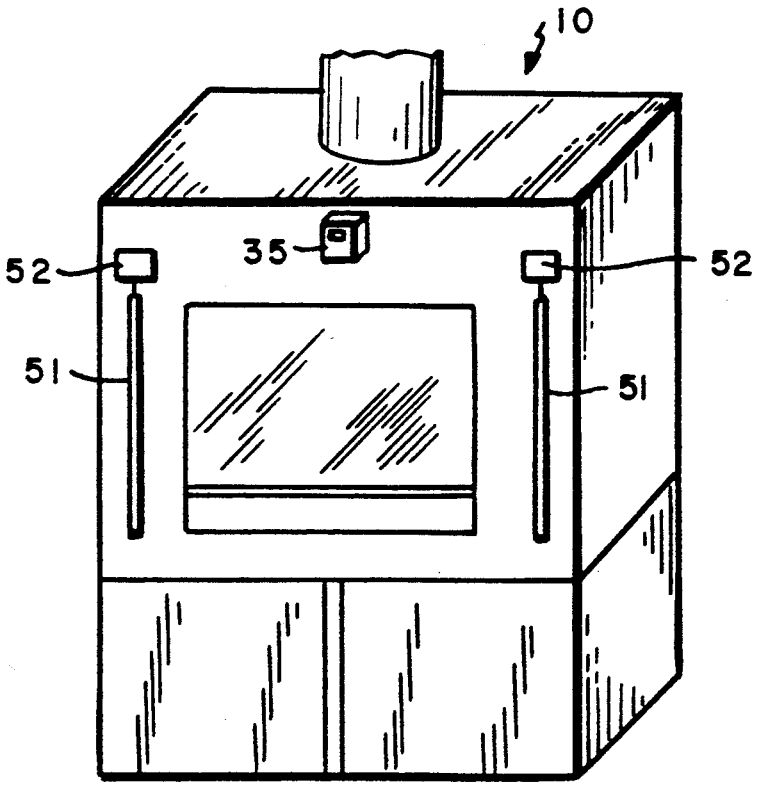
FIG. 6B is a front perspective view of a fume hood illustrating additional containment affecting condition detection elements.

When passive or active detectors such as those shown in FIGS. 3 or 4 are used, the optics cf the system will need to be adjusted to sense the proper area in front of the hood. Some field adjustability is desirable based on the different sizes of hoods and different lab casework layouts in which the hoods are applied. FIG. 6A shows a typical detector zone 50 for a detector 35 that is mounted on a hood 10 as shown in FIG. 6B. In some cases, two or more detectors may need to be used or special optics may be required that can specifically shape the detection field of a single detector. For example, it may prove useful to observe the hood area from a height of 3' or 4' on up to ignore chairs, tables, equipment and other fixed or movable objects. When, for instance, infrared detectors are used, special fresnel type lenses or specially shaped mirrors may be used. The size of the zone 50 would vary with application. For example, the zone might extend 1' to 4' from the front of the hood and beyond each side of the hood by from 0 to 3'.

Other means to implement sensor 35 and detector circuit 34 would be through creating a light curtain or projecting a light beam around the desired detection zone, 50 of FIG. 6A. When an operator crosses and momentarily breaks the light beam, the detector circuit signals the presence of the operator. The circuit of FIG. 4 could be used to implement this type of detector circuit.

In addition to sensing the presence or motion of a user near the hood, there are, as was mentioned earlier, potentially other factors which might dictate the need for a higher face velocity, for example, the presence of an air velocity greater than 30 to 50 FPM such as from a nearby supply air diffuser. Additionally, the presence of apparatus in the first 6" or so of the hood back from the front of the sash can also decrease hood containment, necessitating the need for a higher face velocity.

There are many kinds and types of air velocity sensors that could be used to detect air motion, either in front of or at the corners or sides of the fume hood. Unfortunately, many of these tend to be point sensors such as hot wire or thermistor-type thermal anemometers. A better system would sense the presence of low air velocity over a wider area. One such approach would use long streamers, 51 (FIG. 6B) the length of each such streamer being roughly equal to the height of the sash openings. The streamers 51 would be placed at the front corners or edges of the hood where the hood is most affected by air currents. These streamers would be made of some light material easily moved by wind or other air currents striking the streamer. The motion of the streamers could then be detected by the motion detectors that were described earlier. Alternatively, the motion could be detected directly by a suitable motion detector 52 to which each streamer 51 is attached As each streamer moves, its motion is transmitted to the corresponding detector 52, which senses the motion by for example moving the contact point on a variable resistor or by sensing the variation in pressure, weight or twisting force applied to a sensitive force measuring device such as piezoelectric or strain gauge transducer.

An even simpler approach is to use the pyro-electric or heat sensor mentioned earlier. These devices can be made sensitive to the motion of air that is at a different temperature than the background. For example, the conditioned supply air coming out of a diffuser near a hood is typically 55° F. versus the background room temperature of 70° F. Depending on the turbulence of the airflow near the hood, this air motion would be detected by the pyro electric sensor As mentioned earlier, one other factor affecting hood capture is the presence of apparatus in the first 6" of the hood work surface. This region 55 is shown in FIG. 6A. To sense this condition, a simple active or proximity sensor could be used to send a light or other type of beam from one side to the other side of the inside of the hood. Anything placed in the zone traversed by the beam would signal the system to increase the face velocity. One implementation shown in FIG. 6A has an active transmitter and receiver unit 56. This unit bounces a light, ultrasonic, microwave or other appropriate wavelength beam 58 off reflector 57 and back to the transmitter/receiver unit 56. The circuit of FIG. 4 could again be used to implement the sensor and detector circuits. Pressure sensitive "floor mat" type switches, or equivalent pressure sensing material strips, could also be used to detect the presence of apparatus in "buffer" zone 55.

Another method to determine if there are influences that are disturbing hood containment is to actually measure the containment of the hood in some way such as by releasing a harmless fluid, such as a tracer gas or vapor in the hood and measuring outside the hood to see if any is escaping. This measurement of the hood's containment could be used to help vary the face velocity to the optimum point or to provide a two step operation.

As mentioned earlier, one approach to detect air motion in, around or near the hood is to use an air velocity sensor that measures the air velocity near the hood to directly look for high velocities that could affect containment. Alternatively, an air velocity sensor either in the sidewall or someplace in front of the hood could be used to detect disturbances caused by a user standing in front of the hood or by air turbulence near the hood. The former could be sensed, for example, by observing an increase in the air velocity through the sensor when in fact no change in the actual face velocity (which would also be detected or probably computed by using exhaust volume and sash area measurements) occurred. In order to sense air turbulence, the variations or "noise" in the air velocity signal could be observed. A very noisy signal that was changing a lot would indicate the presence of air turbulence near the hood. In order not to be confused with changes in velocity caused by movement of the sash, the sash position or the effective area of the sash could be monitored if it was desired to separate out any air velocity changes caused by the movement of a sash.

Alternatively the actual exhaust volume of the hood could be measured or metered by appropriate means and this value could be divided by the sash position to generate a calculated face velocity. Variations between this term and the sidewall face velocity could be then compared, particularly on a transient basis, in order to detect disturbance causing conditions around or inside the hood.

Figure 7:
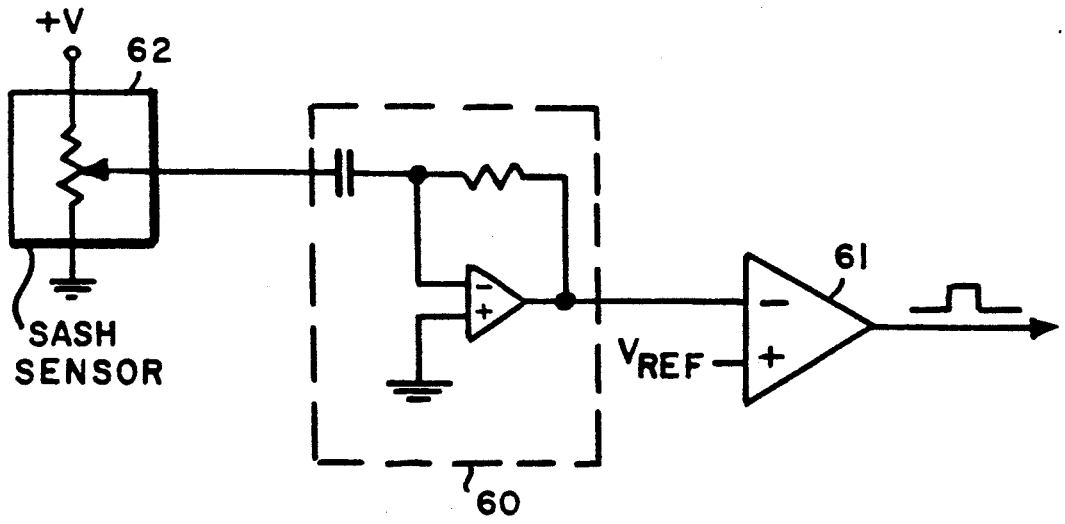
FIG. 7 is a block diagram of a sash position sensing circuit which may be utilized in conjunction with various embodiments of this invention.

The last sensor that might be utilized to vary or change face velocity is a sash movement sensor. Movement of the sash or sashes creates turbulence; therefore, an increase in face velocity during and after the movement of the sash might help to increase the hood's containment of fumes during such an operation. The movement of the sash can be easily sensed by the use of a sash sensor such as those described in U.S. Pat. Nos. 4,528,898 and 4,706,553 where a spring wound, multiturn pot assembly is used to measure sash height. A differentiator circuit such as that shown in FIG. 7 could be used to detect even a small movement of the sash. In this figure, sash sensor 62 produces a variable voltage signal that is differentiated by op amp circuit 60. Comparator 61 compares the differentiated signal to a reference to generate a two state output that could be used to switch a relay when the sash moves.

As mentioned earlier, the system utilized could involve many of the different sensors described above in combination. Also, the outputs of the different sensors might be utilized as variable outputs or as two state or relay outputs in order to detect the magnitude of the disturbance or closeness of a person to the hood. This variable output might be used to create a variable face velocity with a magnitude dependent on the magnitude of the disturbance.

Block 33 of FIG. 2 is the circuit which accepts the relay closure or signal from the disturbance detector or detectors 34 in order to modify the face velocity or volume command of the flow controller 32.

Figure 8:
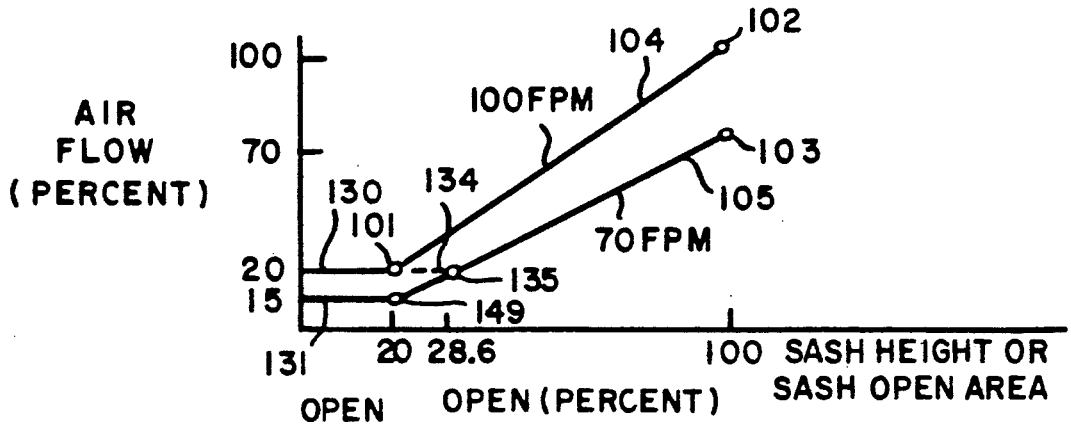
FIGS. 8, 9, 10 and 11 are diagrams illustrating the relationship between air flow and sash position for various embodiments of the invention.

There are several ways in which the face velocity or volume could be changed in order to increase containment when a disturbance occurs. FIG. 8 is a diagram indicating one way that volume could be changed. In this example, the hood is operated with a standby face velocity of 70 FPM which is shown by lines 131 and 105 which intersect at the point 149 of minimum flow, which point in this example occurs at 20% of open area. When a disturbance occurs, the face velocity is increased producing a flow to sash-position curve outlined in FIG. 8 by lines 130 and 104. Under some situations, it may be desirable to maintain the same minimum flow for both standby and active (disturbance) modes. This is shown in FIG. 8 by the curve including lines 130, 134 and 105. In this example the minimum flow occurs at 28.6% of the full open sash at point 135. For operations along lines 130, 131 and 134, face velocity will increase as sash opening decreases to maintain the desired constant flow volume.

Figure 9:
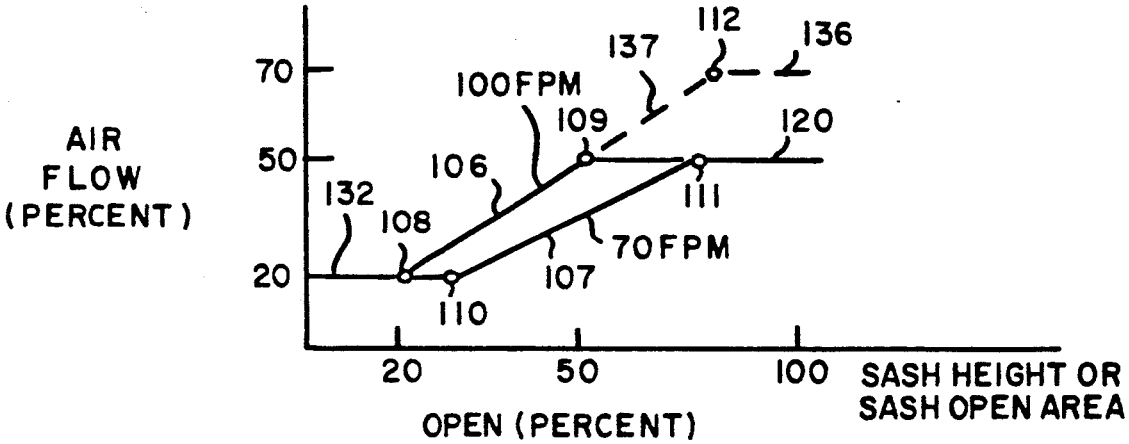

Similarly, it sometimes is advantageous to have a maximum limit for both standby and active modes. FIG. 9 shows this with an example where the standby mode uses 70 FPM within both minimum and maximum limits. The standby mode is indicated by lines 132, 107 and 120. Points 110 and 111 indicate the minimum and maximum limit intercepts, respectively. The active mode at 100 FPM is indicated by lines 132, 106, and 120. The intercept points are 108 and 109 for minimum and maximum limits, respectively. Different maximum limits may also be employed as shown for the 100 FPM curve 132, 106, 137 and 136 where point 112 is the maximum intercept point. Again, for operation along lines 120 or 136, face velocity will decrease as sash opening is increased to maintain constant volume flow.

Figure 10:
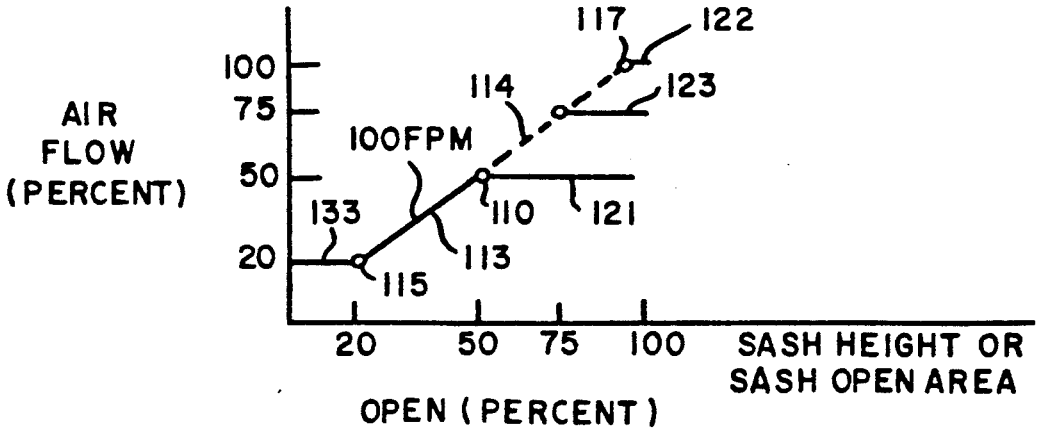

Another way of operating the system is to have the face velocity constant at some value such as 100 FPM, but a maximum clamp is engaged when a disturbance is detected. FIG. 10 illustrates this where lines 133, 113 and 121 would indicate a standby mode with a maximum clamp level of, for example, 50%. Under the active mode, the clamp is raised to 70% as shown by lines 133, 113, 114 and 123. Alternatively the maximum clamp may be eliminated altogether in the active mode as illustrated by extending line 114 to point 117 where 100% open occurs at 100% flow.

Figure 11:
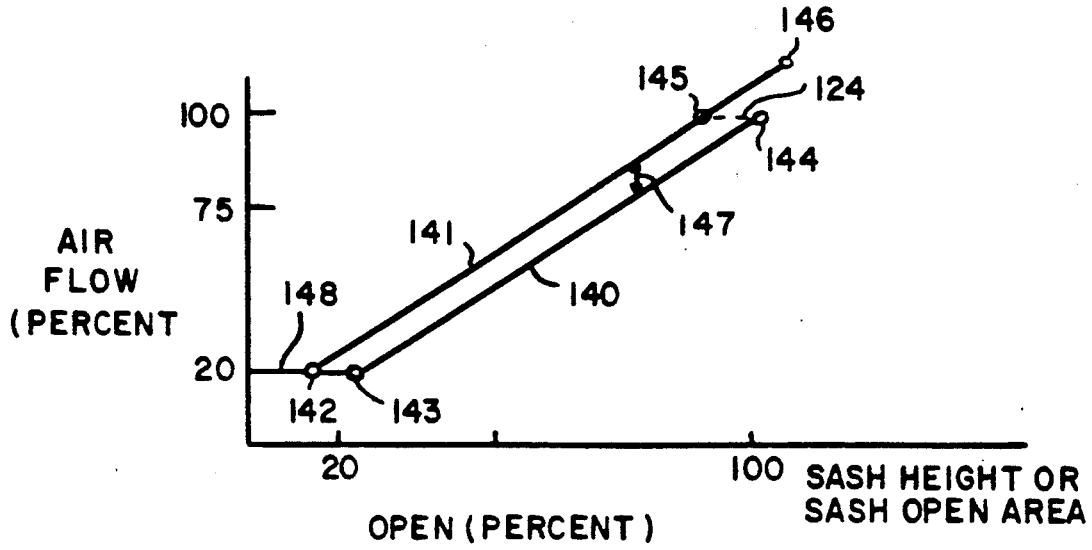

In other cases, it may be useful to add or subtract an offset to the hood's flow versus changes in the face velocity. FIG. 11 shows an example of this where lines 148 and 140 indicate a standby mode and lines 148 and 141 indicate the active mode, offset 147 being the difference. A maximum clamp may also be added in the active mode as shown by line 124 with an intercept point of 145.

It is also possible to operate a fume hood system at a substantially constant volume through most positions of the sashes, with a trip switch or other element being utilized to reduce the volume for sash openings below a selected threshold. This results in a stepped, varying face velocity curve with changes in sash position, the step occurring at the threshold position. This stepped face velocity curve may have an offset superimposed thereon in accordance with the teachings of this invention based on detected containment affecting conditions.

Another variation would be to have multiple face velocity levels or a variable face velocity based on conditions near the hood. Alternatively, a single face velocity could be used with multiple maximum clamps or again a variable maximum clamp based on hood conditions or disturbances. FIG. 10 shows a situation where three different maximum clamps are used. These might correspond, for example, to a standby mode where nc one is near the hood, an active mode where someone is standing quietly near the hood, and a turbulent mode where rapid motion is detected near the hood. The maximum clamps indicated by lines 121, 123, and 122 would correspond, respectively, to these conditions.

Figure 12:
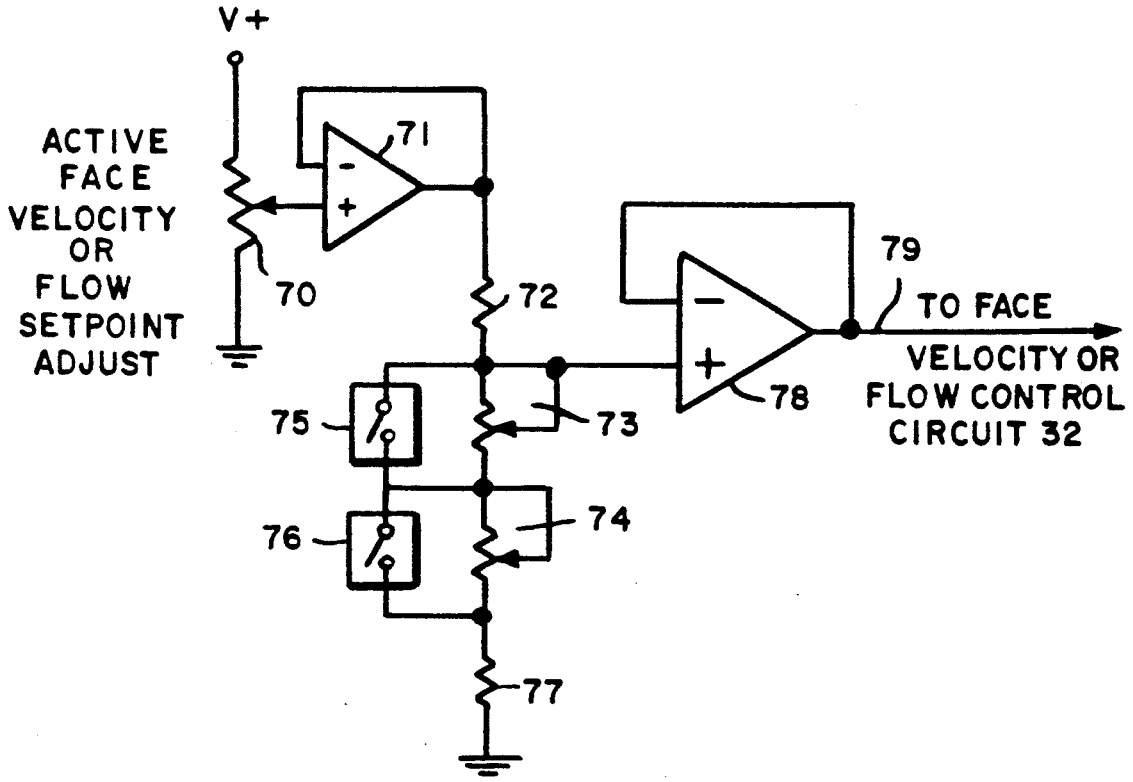
FIG. 12 is a schematic diagram of a circuit for controlling minimum and maximum air flows.

A typical schematic block diagram which could implement block 33 of FIG. 2 for a single or multiple relay contact closure is shown in FIG. 12. In this figure, the active or highest face velocity or flow volume setpoint is provided and adjusted by a trimpot 70 which is buffered by op amp 71 and is then attenuated by the fixed and/or variable resistor string 72, 73, 74, and 77. Relays 75 and 76 are the output relay or relays of the disturbance detector circuitry of block 34. If only two states of operation are desired, then only relay 75 and fixed or variable resistor 73 is used. For three states of operation, relay 76 and resistor 74 can be added as shown. The output of this attenuation circuit can then be buffered as shown in op amp 78. Additional relays and resistors could be added for even more states if desired.

If a true variable control is desired, then the output of op amp 71 could be multiplied by using an analog or digital signal multiplier circuit with a variable output signal from the disturbance detector block 34. The resultant output signal from this multiplier or the output from op amp 78 of FIG. 12 is then used as the face velocity setpoint or volume setpoint value for flow controller 32 of FIG. 2.

As was mentioned earlier, many different volume or face velocity controllers may be used for block 32. Additionally, depending on the control approach desired, an additional circuit block may be needed to provide maximum and/or minimum volume clamps. This block is shown in FIG. 2 as block 39. This block may be implemented with fixed volume clamps or variable clamps that are controlled by the disturbance detector. The circuit of FIG. 12 can be used to implement these variable maximum or minimum clamp setpoint circuits. If both clamps are desired to be variable, then two of these circuits would be needed.

Figure 13:
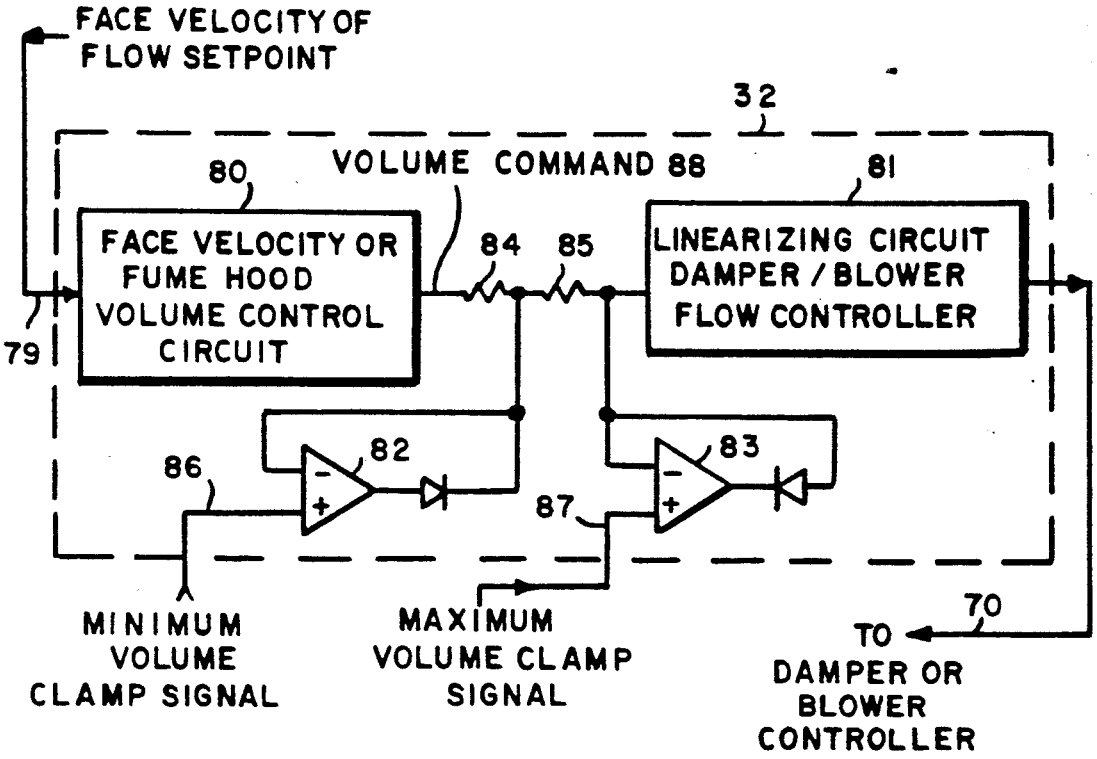
FIG. 13 is a semi-block schematic diagram of a flow controller which may be utilized in conjunction with various embodiments of the invention to control minimum and maximum air flows.

FIG. 13 shows how these clamps could be implemented in conjunction with block 32. The minimum and maximum volume clamp signals 86 and 87 respectively from block 39 of FIG. 2, being either fixed or variable signals, are then used as input signals to the actual volume clamp circuits in block 32. The actual minimum clamp circuit is implemented with op amp 82, its associated diode and resistor 84. The actual maximum clamp circuit is implemented with op amp 83, its associated diode and resistor 85. These clamps work on a linear volume command output on line 88 from velocity or volume control block 80. The linear clamped signal is thus used to drive block 81 which in turn controls the volume moving through a damper, or air flow control valve.

Figure 14:
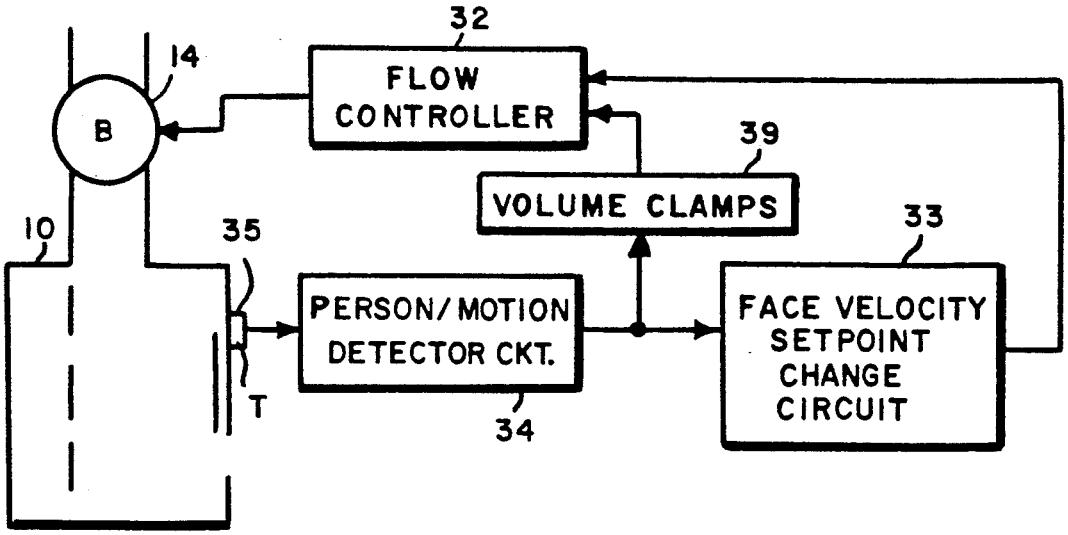
FIG. 14 is a semi-block diagram of still another embodiment of the invention.

If a variable speed drive or inverter is used to control flow instead of a damper, FIG. 14 shows how the system can be implemented. Operation is the same as for FIG. 2, except damper 30 and actuator 31 are replaced by block 14 which consists of a blower and blower speed controller. For the blower system, block 81 (FIG. 13) would be used to control the blower speed.

In both FIGS. 2 and 14, optional sash sensor, velocity sensors or volume sensors can be used in conjunction with the flow controller block 32 to provide proper control of face velocity or flow. U.S. Pat. Nos. 4,528,898 and 4,706,553 illustrate some typical applications and implementations of block 32 using these sensors.

While the invention has been shown and described above with reference to various embodiments, and specific implementations have been shown and suggested for various elements of the system, it is apparent that the various sensor and control circuits shown are merely illustrative and that other devices and techniques might be utilized in particular applications. Thus, while the invention has been particularly shown and described above for the preferred embodiments, the foregoing other changes in form or detail may be made therein by one skilled in the art without departing from the spirit and scope of the invention.

What is claimed is:

1. A controller for use with a fume hood having face velocity control means, the controller comprising means for detecting changes in at least one containment affecting condition; and change means responsive to said detecting means detecting a selected change in containment affecting condition for causing said control means to make a corresponding change in the face velocity of the fume hood to a pre-selected velocity for the changed containment condition, the change means including incrementing means responsive to a detection by said means for detecting of a selected increase in a selected containment affecting condition for causing said control means to increase the face velocity of the fume hood to a selected increased level, and decrementing means responsive to detection by said means for detecting of a selected reduction in a containment affecting condition for causing said control means to reduce the face velocity of the fume hood to a selected decreased level.

2. A controller as claimed in claim 1 wherein said incrementing means operates substantially instantaneously on a detection by said detecting means; and including mean for delaying operations of said decrementing means for a selected time period when a selected reduction is detected.

3. A controller as claimed in claim 1 wherein said means for detection detects the presence of a person within a selected area of the face of the hood.

4. A controller as claimed in claim 1 wherein said means for detection detects movement within a selected area of the face of the hood.

5. A controller as claimed in claim 4 wherein the means for detecting movement detects movement of a person.

6. A controller as claimed in claim 5 wherein said means for detecting also detects the presence of a person within a selected area of the face of the hood.

7. A controller as claimed in claim 4 wherein the means for detecting movement includes means for detecting air motion or turbulance at least outside the hood.

8. A controller as claimed in claim 4 wherein the means for detecting movement includes means for detecting air motion or turbulance at least inside the hood.

9. A controller as claimed in claim 4 wherein the means for detecting movement includes means for detecting air motion or turbulance in a selected area relative to the hood, the means for detecting air motion including a strip of material extending in the area, and means for detecting motion of said strip.

10. A controller as claimed in claim 1 wherein said means for detecting includes means for detecting at least one of weiqht and pressure in a selected area relative to the fume hood face.

11. A controller as claimed in claim 1 wherein said means for detecting includes means for projecting a radiation beam into a selected area relative to the face of the fume hood, means for detecting radiation reflected from said area, and means responsive to the reflected radiation for detecting selected containment affecting conditions in said area.

12. A controller as claimed in claim 1 wherein the means for detecting includes means for ejectinq a tracer fluid in the hood, and means for measuring the quantity of the tracer fluid escaping from the hood.

13. A controller as claimed in claim 1 wherein said means for detecting includes means for detecting the presence of apparatus inside the hood within a predetermined distance from the front of the hood.

14. A controller as claimed in claim 1 wherein the face of the fume hood may be covered by one or more sashes, and wherein said means for detecting includes means for detecting movement of at least one of said sashes.

15. A controller as claimed in claim 1 wherein said control means controls flow volume through the fume hood, and wherein said change means changes flow volume.

16. A controller as claimed in claim 15 including means for establishing a maximum flow volume, and means for changing the maximum flow volume in response to the means for detecting.

17. A controller as claimed in claim 15 including means for establishing a minimum flow volume, and means for changing the minimum flow volume in response to the means for detecting.

18. A controller as claimed in claim 15 including means responsive to the detecting means for effecting an offset in the controlled flow volume.

19. A controller as claimed in claim 15 wherein the fume hood has an opening which may be covered to varying extents by at least one movable sash; and wherein the control means normally maintains a selected volume relative to sash position, the selected volume being maintained being changed by the changing means.

20. A controller as claimed in claim 19 wherein the selected volume is a constant volume regardless of sash position.

21. A controller as claimed in claim 20 wherein said constant volume is constant at a first value for sash openings above a threshold value and at a second value for sash openings below the threshold.

22. A controller as claimed in claim 1 wherein the change means causes a first face velocity in response to a detection by said detecting means and a second lower face velocity in response to the absence of a detection.

23. A controller as claimed in claim 1 wherein there may be varying degrees of containment;

wherein the means for detecting detects the degree of detected containment affecting condition; and wherein the change means includes means for changing the face velocity to a velocity appropriate for the detected degree of containment affecting condition.

24. A controller as claimed in claim 23 wherein the means for chanqing the face velocity is operative to vary the face velocity substantially continuously based on the degree of detected condition.

25. A controller as claimed in claim 1 wherein the face velocity control means includes a speed control for a blower exhausting the fume hood.

26. A controller as claimed in claim 1 wherein the face velocity control means includes means for changing the flow out of the fume hood.

27. A method for controlling a fume hood having face velocity control means comprising the steps of detecting changes in at least one containment affecting condition; and causing said control means to make a corresponding change in the face velocity of the fume hood in response to a detected change in containment affecting condition to a pre-selected velocity for the changed containment condition, said change causing step including the steps of causing said control means to increase the face velocity of the fume hood to a selected increased level in response to the detection during said detecting step of the occurrence of a selected containment affecting condition, and causing said control means to reduce the face velocity of the fume hood to a selected decreased level in response to the detection of a selected reduction in a containment affecting condition.

28. A method as claimed in claim 27 wherein incrementing by the control means occurs substantially instantaneously while decrementing of the control means is delayed for a selected time period.

29. A method as claimed in claim 27 wherein said detecting step includes the step of detecting at least one of the presence of a person within a selected area of the face of the hood, movement of a person within said selected area, detecting air motion or turbulence within a selected area relative to the face of the hood, the presence of apparatus inside the hood within a predetermined distance from the front of the hood, and movement of at least one sash covering the face of the hood.

30. A method as claimed in claim 27 including the steps of establishing at least one of a maximum flow volume and minimum flow volume and changing at least one of the maximum flow volume and minimum flow volume in response to the detection of a containment affecting condition.

* * * * *